US011830461B2

(12) United States Patent
Kuroiwa et al.

(10) Patent No.: US 11,830,461 B2
(45) Date of Patent: Nov. 28, 2023

(54) DEVICE AND METHOD FOR DRIVING A DISPLAY PANEL BASED ON DATA ERROR DETECTION

(71) Applicant: SYNAPTICS INCORPORATED, San Jose, CA (US)

(72) Inventors: Tsuyoshi Kuroiwa, Tokyo (JP); Hirokazu Hatayama, Tokyo (JP); Takefumi Seno, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 298 days.

(21) Appl. No.: 16/720,858

(22) Filed: Dec. 19, 2019

(65) Prior Publication Data

US 2020/0202818 A1 Jun. 25, 2020

(30) Foreign Application Priority Data

Dec. 21, 2018 (JP) ..... 2018-240234

(51) Int. Cl.
*G09G 5/393* (2006.01)

(52) U.S. Cl.
CPC ..... *G09G 5/393* (2013.01); *G09G 2310/0286* (2013.01); *G09G 2310/062* (2013.01); *G09G 2310/08* (2013.01)

(58) Field of Classification Search
CPC ..... G09G 5/393; G09G 2310/0286; G09G 2310/062; G09G 2310/08
See application file for complete search history.

(56) References Cited

U.S. PATENT DOCUMENTS

2014/0049532 A1 2/2014 Choi et al.
2014/0340380 A1 11/2014 Song et al.
2016/0299188 A1* 10/2016 Woo ..... G01R 31/31703
2018/0075798 A1* 3/2018 Nho ..... G09G 3/32
2019/0013826 A1* 1/2019 Kikuta ..... H04N 7/183

FOREIGN PATENT DOCUMENTS

JP 10161595 A 6/1998
JP 2008152024 A 7/2008
JP 2015087608 A 5/2015

OTHER PUBLICATIONS

Office Action in counterpart Japanese Application No. 2008240234, dated Oct. 26, 2022 with English translation (8 pages).
Office Action in counterpart Japanese Application No. 2018240234, dated Mar. 7, 2023 with English translation (6 pages).

* cited by examiner

*Primary Examiner* — Wing H Chow
(74) *Attorney, Agent, or Firm* — Leydig, Voit & Mayer, Ltd.

(57) ABSTRACT

A display driver comprises an interface and signal supply circuitry. The interface is configured to receive image data. The signal supply circuitry is configured to supply at least one drive control signal to a display panel based on a detection of a data error in the image data associated with a first horizontal line in a first vertical sync period, causing a first pixel circuit and a second pixel circuit hold, in the first vertical sync period, first hold voltages based in part on at least one drive control signal and second hold voltages held in a second vertical sync period prior to the first vertical sync period. The first pixel circuit is associated with the first horizontal line, and the second pixel circuit is associated with a second horizontal line and driven after the first pixel circuit.

18 Claims, 14 Drawing Sheets

DEVICE AND METHOD FOR DRIVING A DISPLAY PANEL BASED ON DATA ERROR DETECTION

CROSS REFERENCE

This application claims priority to Japanese Patent Application No. 2018-240234, filed on Dec. 21, 2018, the disclosure of which is incorporated herein by reference in its entirety.

BACKGROUND

Field

Embodiments disclosed herein generally relate to a device and method for driving a display panel.

Description of the Related Art

A display driver may be configured to receive image data, for example, from a host and drive pixel circuits of a display panel to display an image corresponding to the received image data. The displayed image may be broken when a data error occurs in the image data.

SUMMARY

In one or more embodiments, a display driver comprises an interface and signal supply circuitry. The interface is configured to receive image data. The signal supply circuitry is configured to supply at least one drive control signal to a display panel based on a detection of a data error in the image data associated with a first horizontal line in a first vertical sync period, causing a first pixel circuit and a second pixel circuit in the display panel to hold, in the first vertical sync period, first hold voltages based on in part on the at least one drive control signal and second hold voltages held in a second vertical sync period. The second vertical sync period is prior to the first vertical sync period. The first pixel circuit is associated with the first horizontal line, and the second pixel circuit is associated with a second horizontal line and driven after the first pixel circuit.

In one or more embodiments, a display driver comprises an interface and signal supply circuitry. The interface is configured to receive first image data and second image data. The signal supply circuitry is configured to, based on a detection of a data error in the first image data associated with a first horizontal line in a first vertical sync period, supply drive signals based on the second image data to pixel circuits of a second horizontal line of a display panel which are driven after the detection of the data error in the first vertical sync period. The second image data is transmitted to the interface before the detection of the data error in the first vertical sync period.

In one or more embodiments, a display driver comprises an interface and signal supply circuitry. The signal supply circuitry comprises a frame memory and is configured to supply drive signals to a display panel, and based on a detection of a data error in a first image data block of image data received by the interface, omit writing the first image data block into the frame memory.

In one or more embodiments, a method comprises receiving image data, and supplying at least one drive control signal to a display panel. Supplying at least one the drive control signal to the display panel comprises supplying the at least one drive control signal based on a detection of a data error in the image data associated with a first horizontal line in a first vertical sync period to cause a first pixel circuit and a second pixel circuit to hold, in the first vertical sync period, first hold voltages based in part on the second hold voltages held in a second vertical sync period. The second vertical sync period is prior to the first vertical sync period. The first pixel circuit is associated with the first horizontal line, and the second pixel circuit is associated with a second horizontal line and driven after the first pixel circuit.

The languages "first" and "second", which are used to simplify the description, merely specify arbitrary horizontal lines, image data, image data blocks or the like, not meaning the vertical sync periods, the horizontal lines, the image data, and the image data blocks which firstly and secondly appear in the time domain.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
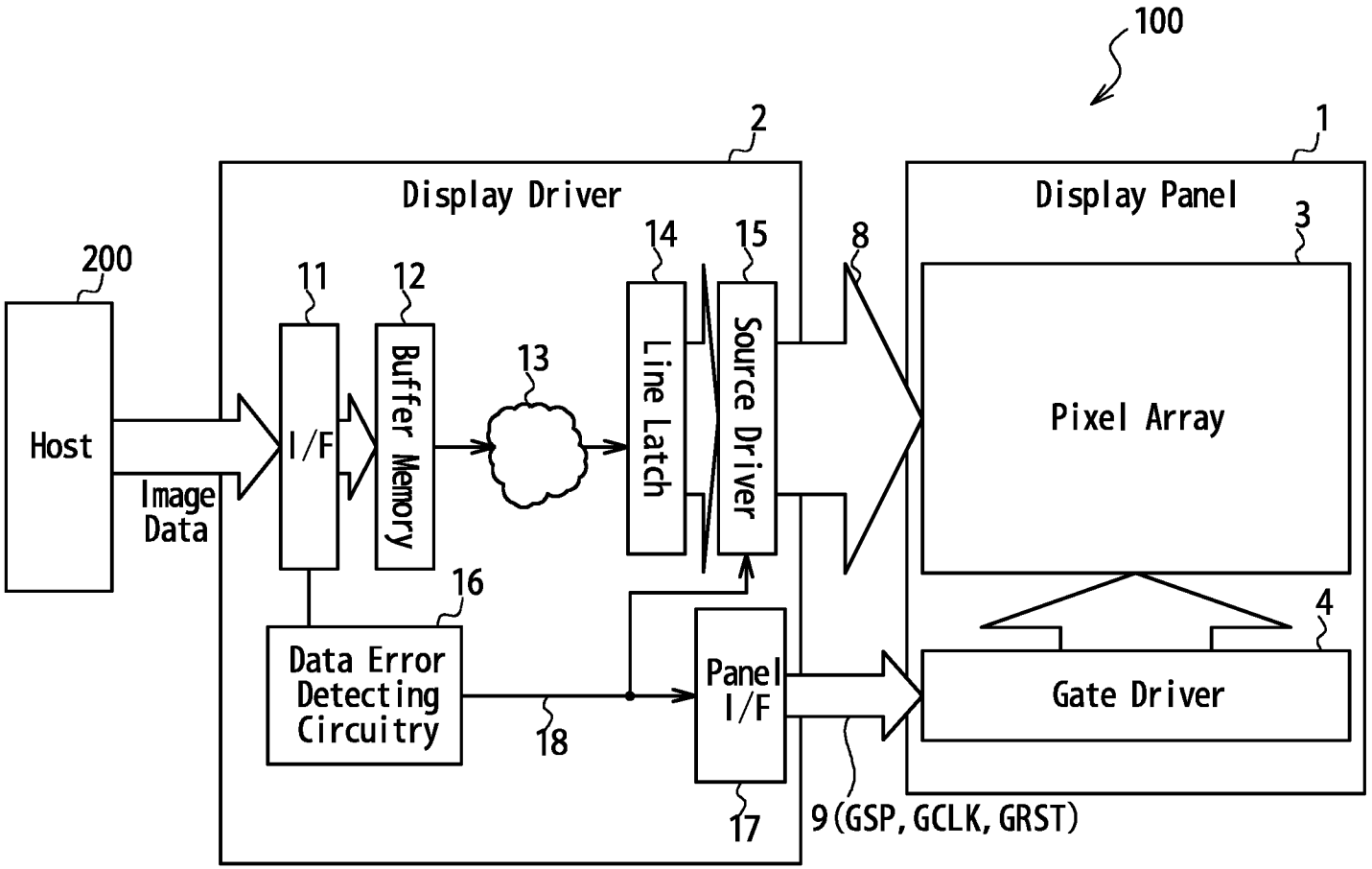
FIG. 1 is a block diagram illustrating an example configuration of a display device, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

In one or more embodiments, as illustrated in FIG. 1, a display device 100 comprises a display panel 1 and a display driver 2. The display device 100 may be configured to drive the display panel 1 based on image data supplied to the display driver 2 from a host 200 to display an image corresponding to the image data on the display panel 1. The host 200 may comprise a processor, such as an application processor, a central processing unit (CPU), a graphic processing unit (GPU), and/or a digital signal processor (DSP).

In one or more embodiments, the display panel 1 comprises a pixel array 3 and a gate driver 4.

Figure 2:
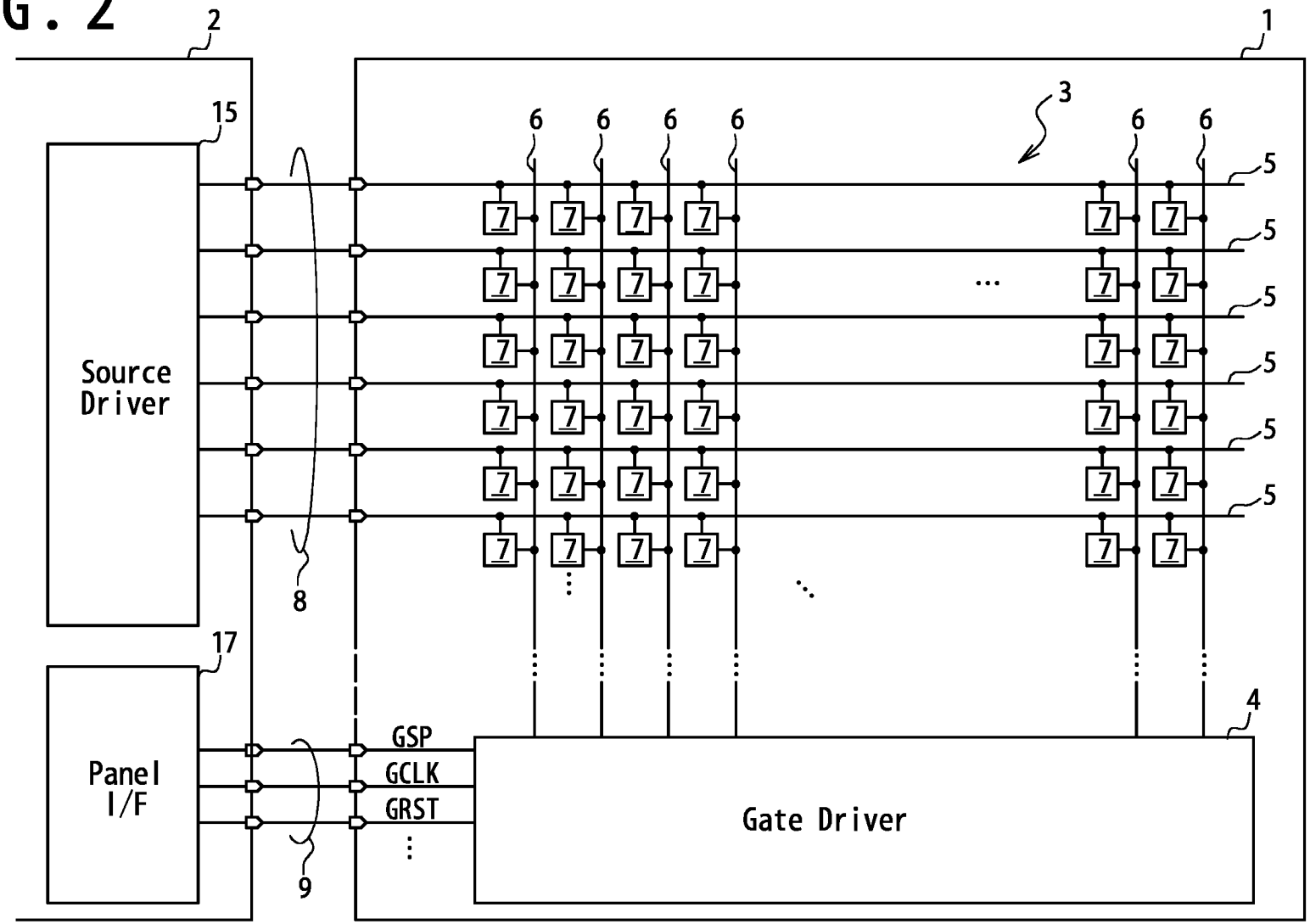
FIG. 2 illustrates an example configuration of a display panel, according to one or more embodiments.

In various embodiments, as illustrated in FIG. 2, the pixel array 3 comprise source lines 5, gate lines 6, and pixel circuits 7 disposed at respective intersections of the source lines 5 and the gate lines 6. The source lines 5 may be connected to the display driver 2 and configured to receive drive signals 8 having voltage levels corresponding to grayscale values of the respective pixel circuits 7 from the display driver 2. When a gate line 6 is asserted, voltages generated on the source lines 5 may be written into corresponding pixel circuits 7 connected to the gate line 6 as hold voltages.

The gate driver 4 may be configured to drive the gate lines 6 based on gate control signals 9 received from the display driver 2. In one or more embodiments, the gate control signals 9 comprise a gate clock signal GCLK and a gate start pulse signal GSP. The gate control signals 9 may further comprise a gate reset signal GRST. In one or more embodiments, the gate driver 4 is configured as a shift register that operates in synchronization with the gate clock signal GCLK. The gate driver 4 may be configured to start a shift operation synchronous with the gate clock signal GCLK when the gate start pulse signal GSP is activated. This shift operation may sequentially select and assert the gate lines 6 connected to the respective stages of the shift register. In embodiments where the gate driver 4 resets the shift register (e.g., based on the gate reset signal GRST), the gate driver 4 may be further configured to omit driving the gate lines 6 after the gate reset signal GRST has been asserted.

Referring back to FIG. 1, in one or more embodiments, the display driver 2 comprises an interface 11, a buffer memory 12, an image processing intellectual property (IP) core 13, a line latch 14, a source driver 15, data error detecting circuitry 16, and a panel interface 17.

The interface 11 may be configured to perform data communications with the host 200 to receive various data used for driving the display panel 1 with the display driver 2. The data received from the host 200 may comprise image data specifying grayscale values of the respective pixel circuits 7. The interface 11 may be configured to sequentially forward the image data received from the host 200 to the buffer memory 12.

In one or more embodiments, the buffer memory 12, the image processing IP core 13, the line latch 14, the source driver 15, the data error detecting circuitry 16, and the panel interface 17 may constitute signal supply circuitry configured to supply drive control signals to the display panel 1 based on data received from the host 200. In various embodiments, the drive control signals may comprise the drive signals 8 and the gate control signals 9.

The buffer memory 12 may be configured to temporarily store therein the image data sequentially received from the interface 11. The buffer memory 12 may have a capacity to store image data associated with pixel circuits 7 of one horizontal line, that is, pixel circuits 7 connected to one gate line 6.

The image processing IP core 13 may be configured to perform desired image processing on the image data received from the buffer memory 12.

The line latch 14 may be configured to temporarily store therein image data generated by the image processing in the image processing IP core 13. In one embodiment, the capacity of the line latch 14 corresponds to the image data associated with pixel circuits 7 of at least one horizontal line. In other embodiments, the capacity of the line latch 14 corresponds to the image data associated with pixel circuits 7 of two or more horizontal lines.

In one or more embodiments, the source driver 15 is configured to generate the drive signals 8 to be supplied to the respective source lines 5 based on the image data received from the line latch 14. The hold voltages held in the respective pixel circuits 7 may be updated by writing the drive signals 8 into the respective pixel circuits 7.

In one or more embodiments, the data error detecting circuitry 16 is configured to detect a data error in the image data. Examples of the detected data error may include a data error that occurs in the image data in a data communication between the host 200 and the interface 11. Such a data error may occur when electrostatic discharge (ESD) noise is present in the signal line used for the data communication from the host 200 to the display driver 2, for example. Note that a possible data error is not limited to those recited herein. The data transmitted from the host 200 may comprise cyclic redundancy check (CRC) codes, and, in such cases, a data error in the image data may be detected by using the CRC codes. In one or more embodiments, the data error detecting circuitry 16 is configured to, when detecting a data error, assert a data error occurrence notification signal 18 that notify the source driver 15 and the panel interface 17 of the occurrence of the data error.

The panel interface 17 may be configured to generate the gate control signals 9. As described above, the gate control signals 9 may comprise the gate clock signal GCLK, the gate start pulse signal GSP, and optionally the gate reset signal GRST.

Figure 3:
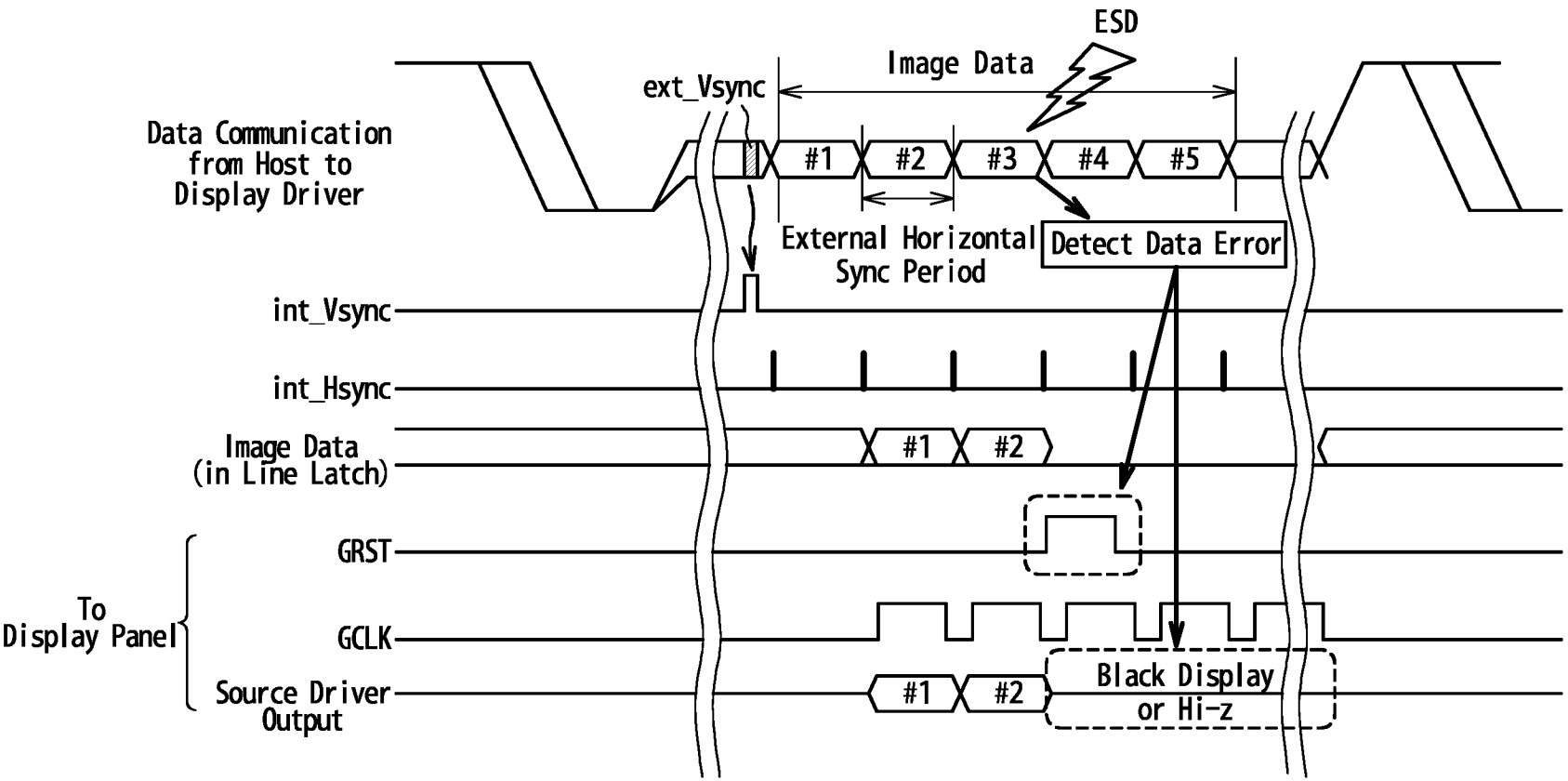
FIG. 3 is a timing chart illustrating an example operation of a display device, according to one or more embodiments.

With reference to FIG. 3, in one or more embodiments, the display driver 2 is configured to stop, based on detection of a data error in image data associated with a horizontal line in a vertical sync period, updating the hold voltages of the pixel circuits 7 of one or more horizontal lines for which corresponding image data are not yet transmitted in the vertical sync period. In such embodiments, the pixel circuits 7 of the horizontal lines for which the corresponding image data are not yet transmitted continue to hold the hold voltages that depend on the hold voltages held by these pixel circuits 7 in the previous vertical sync period. This operation may suppress image disturbance when a data error occurs in the image data since the image to be displayed in the current vertical sync period is often similar to that displayed in the previous vertical sync period.

In one or more embodiments, the display device 100 may be configured to operate as follows. The host 200 may send image data associated with pixel circuits 7 of respective horizontal lines to the display driver 2 after sending a Vsync packet to instruct the display driver 2 to start a vertical sync period. In FIG. 3, the Vsync packet is denoted by "ext_Vsync".

In one or more embodiments, when the Vsync packet is transmitted to the display driver 2, an internal vertical sync signal int_Vsync is asserted in the display driver 2 to initiate a vertical sync period. The panel interface 17 may start supplying the gate clock signal GCLK to the gate driver 4 and further assert the gate start pulse signal GSP, based on the assertion of the internal vertical sync signal int_Vsync. The gate driver 4 may start a shift operation to sequentially assert the gate lines 6 based on the assertion of the gate start pulse signal GSP. The source driver 15 may supply the drive signals 8 to the respective source lines 5 in synchronization with the assertions of the gate lines 6. In such embodiments, hold voltages corresponding to the voltage levels of the drive signals 8 may be written into the pixel circuits 7 of the respective horizontal lines to update the hold voltages in the pixel circuits 7. In embodiments as illustrated in FIG. 3, image data associated with pixel circuits 7 of horizontal lines #1 and #2 are transmitted to the display driver 2, and hold voltages corresponding to the voltage levels of the drive signals 8 are written into the pixel circuits 7 of horizontal lines #1 and #2.

In one or more embodiments, the display device 100 is configured to operate as follows when a data error occurs in the image data associated with the pixel circuits 7 of the next horizontal line #3.

In various embodiments, the data error detecting circuitry 16 asserts the data error occurrence notification signal 18 when detecting the data error. In one or more embodiments, the panel interface 17 asserts the gate reset signal GRST based on the assertion of the data error occurrence notification signal 18. Further, in one or more embodiments, the gate driver 4 omits to assert other gate lines 6 during the rest of the current vertical sync period after the assertion of the gate reset signal GRST.

After the detection of the data error, the source driver 15 may supply drive signals 8 corresponding to "black" to all the source lines 5 based on the assertion of the data error occurrence notification signal 18. The drive signals 8 corresponding to "black" may have a voltage level corresponding to the minimum grayscale value. Alternatively, the source driver 15 may set all the source lines 5 to the high-impedance (Hi-Z) state.

In such embodiments, drive signals 8 are not written into pixel circuits 7 connected to gate lines 6 that are not asserted in the vertical sync period in which the data error occurs, and the hold voltages that have been held in the previous vertical sync period are retained in the pixel circuits 7. As a result, the hold voltages are updated only in the pixel circuits 7 of horizontal lines #1 and #2 in the vertical sync period in which the data error occurs, and the hold voltages that have been held in the previous vertical sync period are retained in the pixel circuits 7 of the remaining horizontal lines. This operation may make it hard for the user to perceive image disturbance when a data error occurs in the image data since an image displayed in the current vertical sync period is often similar to that displayed in the previous vertical sync period.

Figure 4:
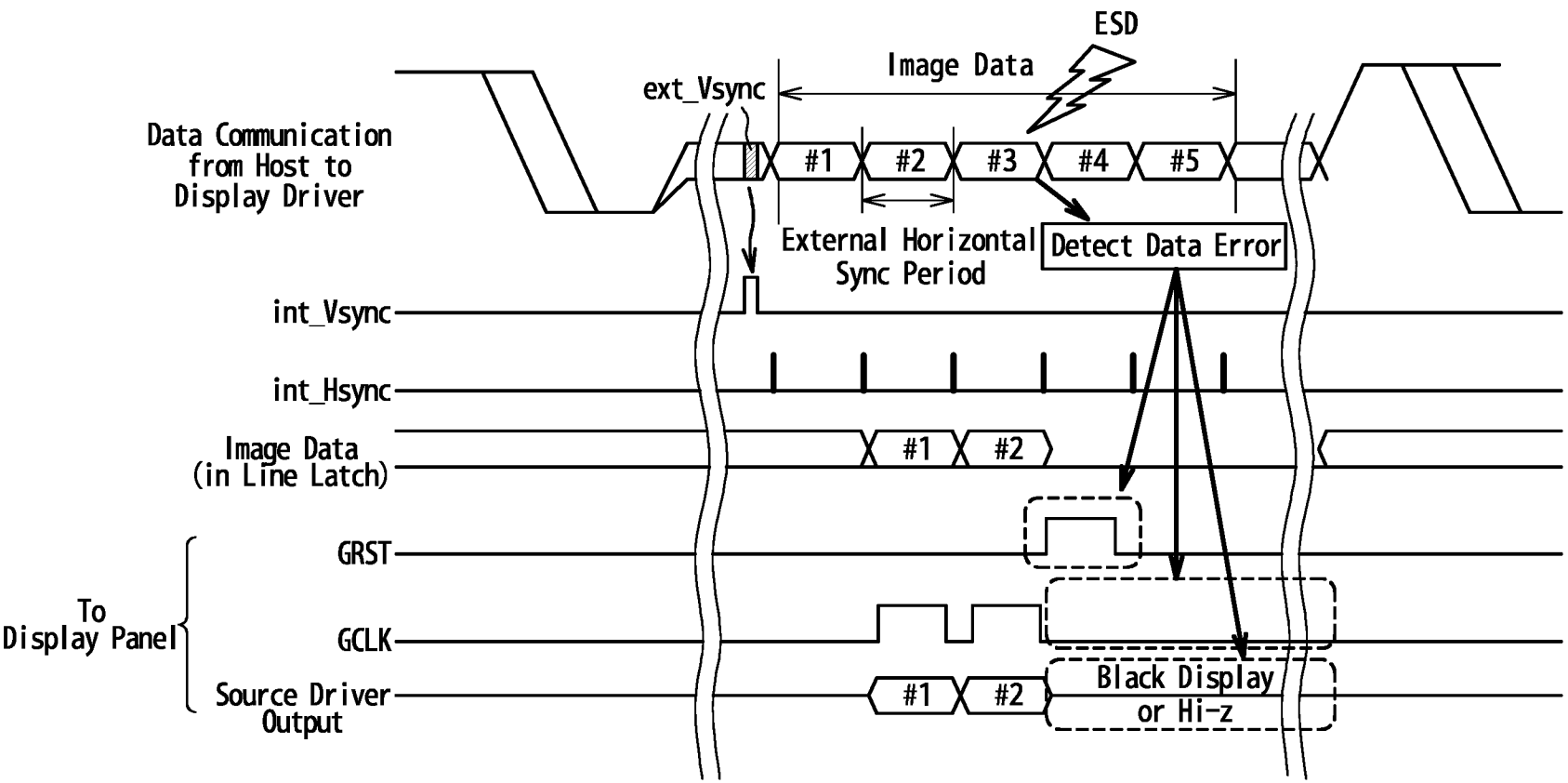
FIG. 4 is a timing chart illustrating an example operation of a display device, according to one or more embodiments.

In other embodiments, as illustrated in FIG. 4, the panel interface 17 may be configured to, when a data error is detected, assert the gate reset signal GRST and further stop supplying the gate clock signal GCLK. This operation may reduce power consumption.

Figure 5:
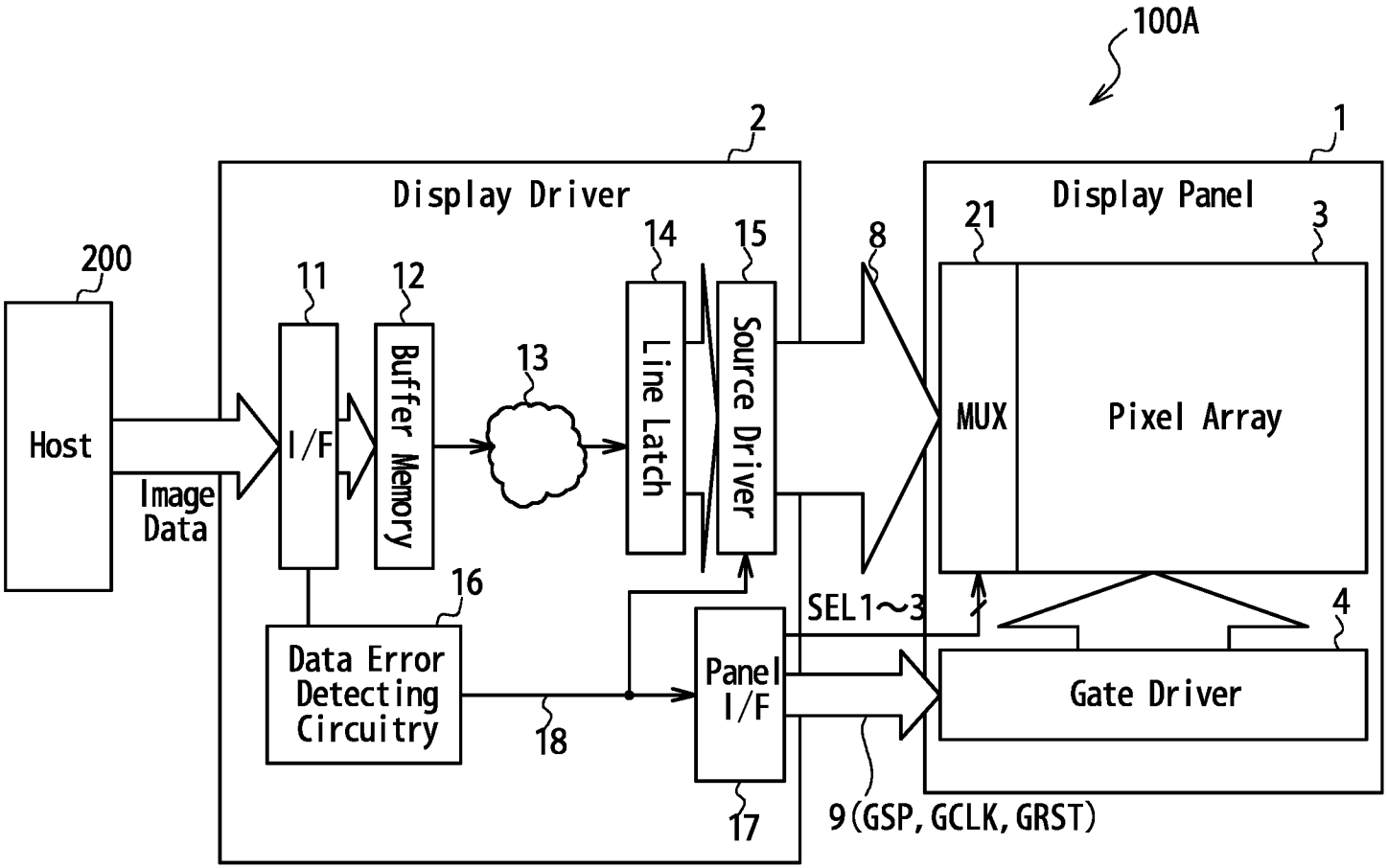
FIG. 5 is a block diagram illustrating an example configuration of a display device, according to one or more embodiments.
Figure 6:
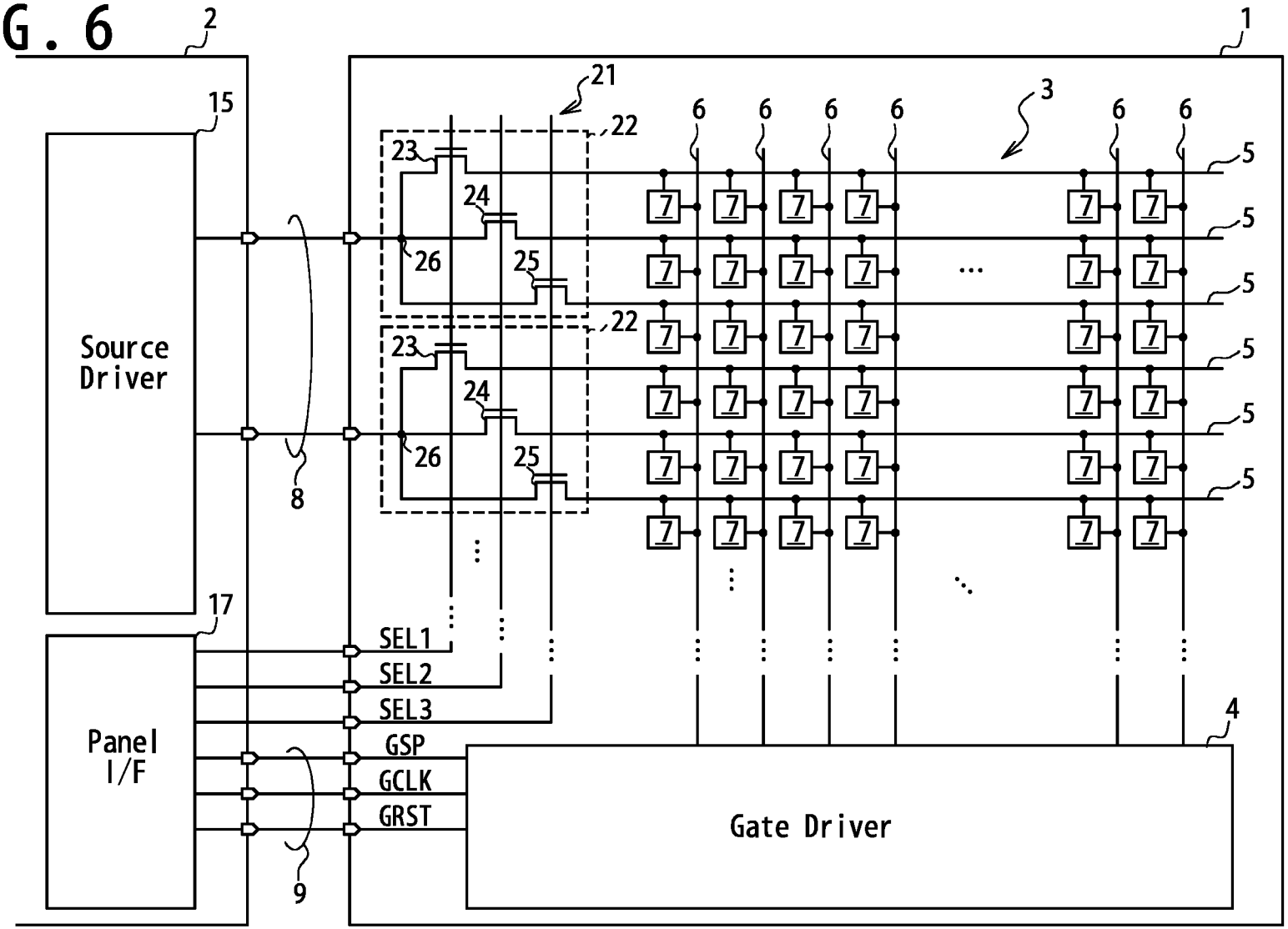
FIG. 6 illustrates an example configuration of a display panel, according to one or more embodiments.

As illustrated in FIG. 5, multiplexer circuitry 21 may be integrated in the display panel 1 to achieve time-division driving. In one or more embodiments, as illustrated in FIG. 6, the multiplexer circuitry 21 comprises one multiplexer 22 for three source lines 5. In various embodiments, a common connection node 26 of each multiplexer 22 is connected to the source driver 15 of the display driver 2. Each multiplexer 22 may comprise MOS switches 23, 24, and 25. Each multiplexer 22 may be configured to selectively connect to the common connection node 26 to one of the corresponding three source lines 5.

In one or more embodiments, source lines 5 to be connected to the common connection nodes 26, that is, source lines 5 to be connected to the source driver 15 are selected based on select signals SEL1, SEL2, and SEL3 supplied from the display driver 2. In various embodiments, when the select signal SEL1 is asserted, the MOS switch 23 of each multiplexer 22 is turned on to allow each multiplexer 22 to connect the source line 5 connected to the MOS switch 23 to the source driver 15. In various embodiments, when the select signal SEL2 is asserted, the MOS switch 24 of each multiplexer 22 is turned on to allow each multiplexer 22 to connect the source line 5 connected to the MOS switch 24 to the source driver 15. In various embodiments, when the select signal SEL3 is asserted, the MOS switch 25 of each multiplexer 22 is turned on to allow each multiplexer 22 to connect the source line 5 connected to the MOS switch 25 to the source driver 15. In one or more embodiments, when all the select signals SEL1, SEL2, and SEL3 are deasserted, all the source lines 5 are disconnected from the source driver 15 and set to the high-impedance state.

The hold voltages of the respective pixel circuits 7 may be updated by sequentially asserting the select signals SEL1 to SEL3 in each horizontal sync period and supply drive signals 8 to source lines 5 selected in synchronization with the assertions of the select signals SEL1 to SEL3.

While FIG. 6 illustrates the configuration in which each multiplexer 22 of the multiplexer circuitry 21 is configured to connect a source line 5 selected from among three corresponding source lines 5 to the source driver 15, the number of source lines 5 selected by each multiplexer 22 is not limited to three.

Figure 7:
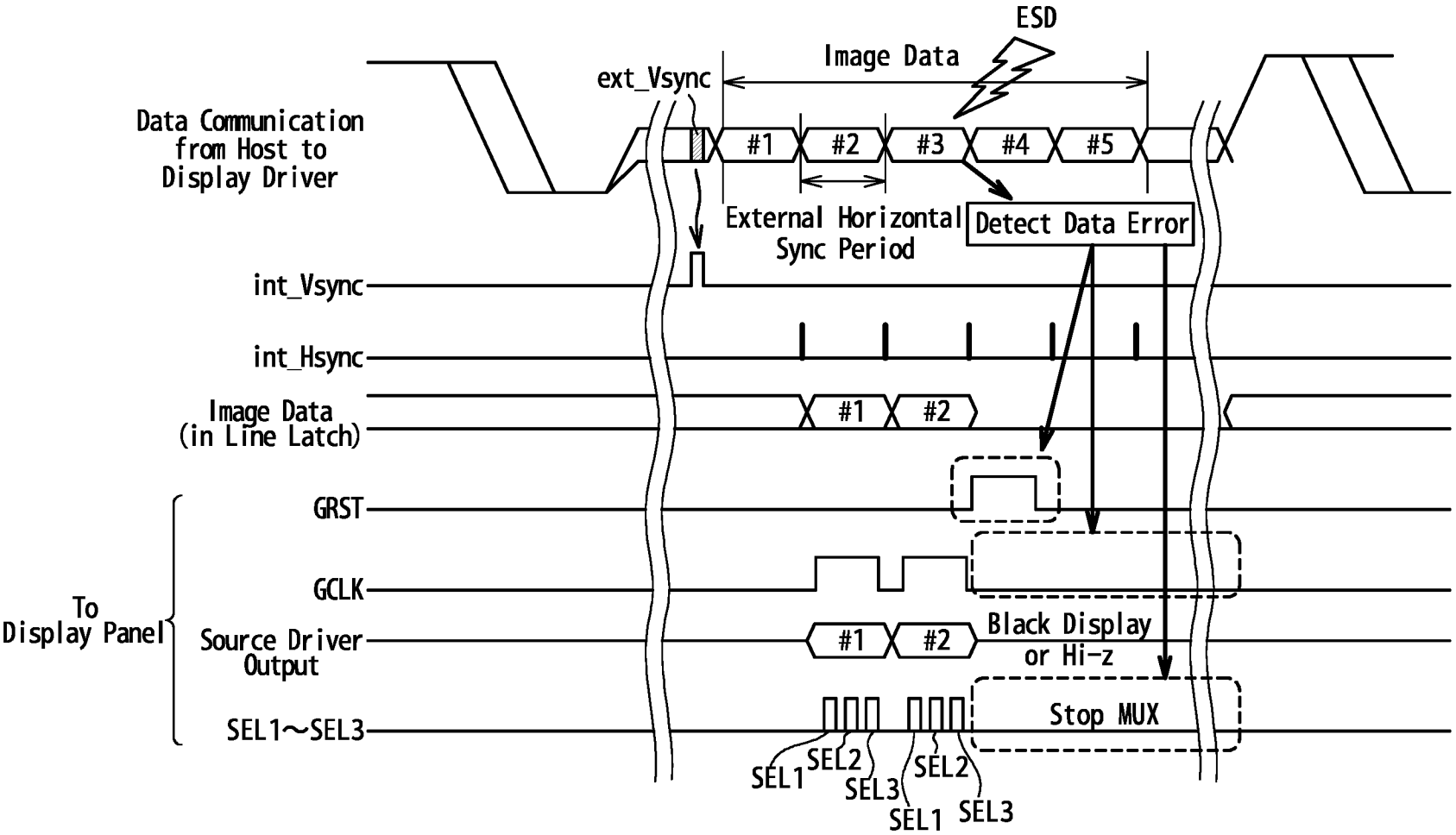
FIG. 7 is a timing chart illustrating an example operation of a display device, according to one or more embodiments.

Image disturbance perceivable by the user may be suppressed through the operation as illustrated in FIGS. 3 and 4 also when time-division driving is performed. In one or more embodiments, as illustrated in FIG. 7, the panel interface 17 asserts the gate reset signal GRST when a data error is detected. This causes the gate driver 4 to assert no other gate lines 6 during the rest of the current vertical sync period from then on. In one or more embodiments, hold voltages are not written into the pixel circuits 7 connected to the gate lines 6 which are not asserted in the current vertical sync period, and the hold voltages held in the previous vertical sync period are retained in such pixel circuits 7. This operation may suppress image disturbance.

The panel interface 17 may stop supplying the gate clock signal GCLK in the operation illustrated in FIG. 7. Alternatively or additionally, the panel interface 17 may deassert the select signals SEL1 to SEL3 to set the source lines 5 to the high impedance state during the rest of the current vertical sync period.

Figure 8:
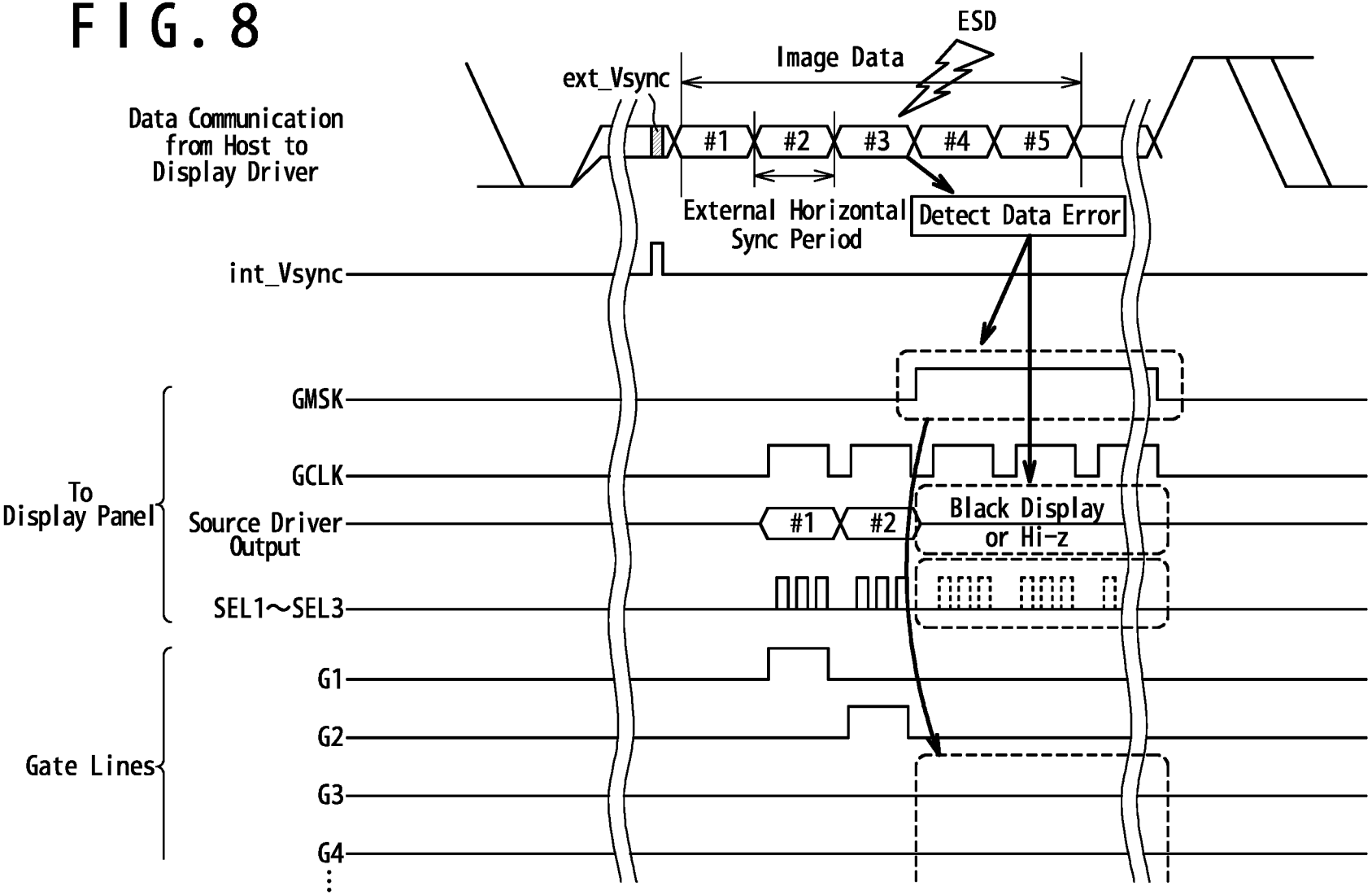
FIG. 8 is a timing chart illustrating an example operation of a display device, according to one or more embodiments.

As illustrated in FIG. 8, the panel interface 17 may be configured to supply a gate mask signal GMSK to the gate driver 4 in place of or in addition to the gate reset signal GRST. The gate mask signal GMSK may be used to prohibit assertion of all the gate lines 6. The gate driver 4 may unconditionally deassert all the gate lines 6, prohibited from asserting the gate lines 6, while the gate mask signal GMSK is asserted.

In such embodiments, the panel interface 17 may be configured to, when a data error is detected, assert the gate mask signal GMSK during the rest of the current vertical sync period based on the assertion of the data error occurrence notification signal 18. The gate driver 4 may be configured to omit to assert the gate lines 6 while the gate mask signal GSMK is asserted. In one or more embodiments, drive signals 8 are not written into the pixel circuits 7 connected to the gate lines 6 which are not asserted in the current vertical sync period, and the hold voltages held in the previous vertical sync period are retained in such pixel circuits 7. This operation may suppress image disturbance perceivable by the user.

The operation illustrated in FIG. 8 may be applicable to the display driver 100A illustrated in FIGS. 5 and 6, in which the multiplexer circuitry 21 is integrated in the display panel 1, as well as the display device 100 illustrated in FIGS. 1 and 2. In such embodiments, the panel interface 17 may be configured to, after a data error is detected, deassert the select signals SEL1 to SEL3 to set the source lines 5 to the high-impedance state during the rest of the current vertical sync period.

Figure 9:
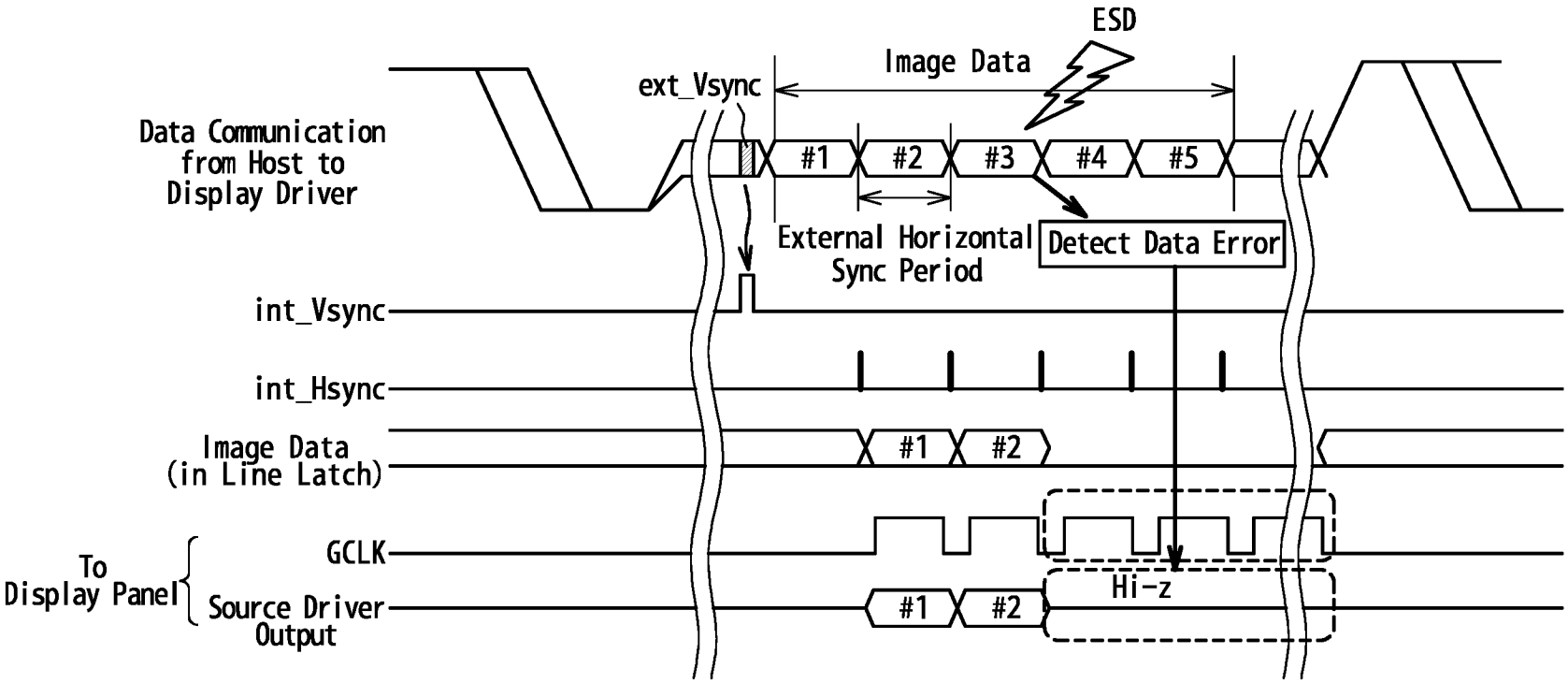
FIG. 9 is a timing chart illustrating an example operation of a display device, according to one or more embodiments.

In one or more embodiments, as illustrated in FIG. 9, the source driver 15 in the display device 100 illustrated in FIGS. 1 and 2 is configured to, after a data error is detected, set the source lines 5 to the high-impedance state during the rest of the current vertical sync period. In one or more embodiments, the operation of sequentially asserting the gate lines 6 is continued after a data error is detected, differently from the operations illustrated in FIGS. 4, 7, and 8. When a gate line 6 is asserted, voltages generated on the source lines 5 may be written into the pixel circuits 7 connected to the gate line 6 as hold voltages.

This operation may also suppress image disturbance since an image is displayed which is correlated to some extent with the image that have been displayed in the previous vertical sync period. In one or more embodiments, as illustrated in FIG. 9, a data error occurs in image data associated with horizontal line #3 in the display device 100 in which the display panel 1 comprises N gate lines 6, that is, pixel circuits 7 of horizontal lines #1 to #N.

In such embodiments, hold voltages based on image data transmitted to the display driver 2 in the current vertical sync period may be written into the pixel circuits 7 of horizontal lines #1 and #2.

In various embodiments, hold voltages written into the pixel circuits 7 of horizontal line #3 in the current vertical sync period may not be identical to but depend on the hold voltages held in the pixel circuits 7 of horizontal line #3 in the previous vertical sync period. In such embodiments, the hold voltages held in the pixel circuits 7 of horizontal line #3 in the previous vertical sync period are dependent on the image data transmitted to the display driver 2 in the previous vertical sync period.

In one or more embodiments, hold voltages depending on the hold voltages held in the pixel circuits 7 of horizontal lines #3 and #4 in the previous vertical sync period are written into the pixel circuits 7 of horizontal line #4 in the current vertical sync period. In such embodiments, hold voltages depending on image data that are associated with horizontal lines #3 and #4 and have been transmitted to the display driver 2 in the previous vertical sync period are written into the pixel circuits 7 of horizontal line #4 in the current vertical sync period.

Further, hold voltages depending on the hold voltages that have been held in the pixel circuits 7 of horizontal lines #3 to #i in the previous vertical sync period may be written into the pixel circuits 7 of horizontal line #i in the current vertical sync period. In such embodiments, hold voltages depending on image data that are associated with horizontal lines #3 to #i and have been transmitted to the display driver 2 in the previous vertical sync period may be written into the pixel circuits 7 of horizontal line #i in the current vertical sync period.

In the above-described embodiments in which the hold voltages depending on the image data that have been transmitted to the display driver 2 in the previous vertical sync period are written into the pixel circuits 7 of horizontal lines #3 to #N, an image displayed by the pixel circuits 7 of horizontal lines #3 to #N in the current vertical sync period may be correlated to some extent with the image that have been displayed in the previous vertical sync period. This may contribute to suppression of image disturbance perceivable by the user.

Figure 10:
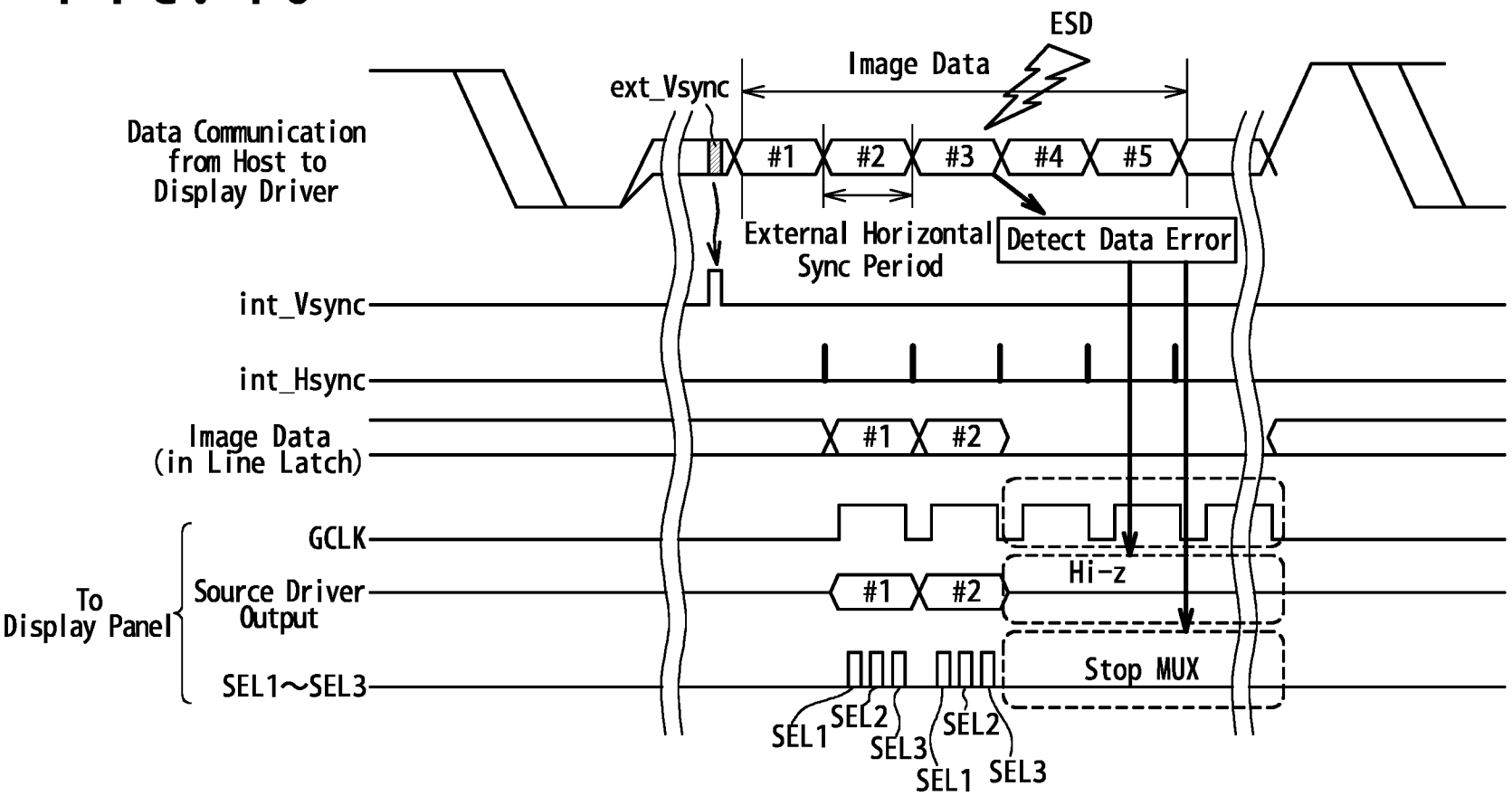
FIG. 10 is a timing chart illustrating an example operation of a display device, according to one or more embodiments.

As for the display device 100A illustrated in FIGS. 5 and 6, in which the multiplexer circuitry 21 is integrated in the display panel 1, as illustrated in FIG. 10, the panel interface 17 may be configured to, after a data error is detected, deassert the select signals SEL1 to SEL3 during the rest of the current vertical sync period to set the source lines 5 to the high-impedance state. The source driver 15 may be configured to set the outputs thereof to the high-impedance state in the meanwhile. This operation may also display an image correlated to some extent with the image that have been displayed in the previous vertical sync period, thereby suppressing image disturbance perceivable by the user.

Figure 11:
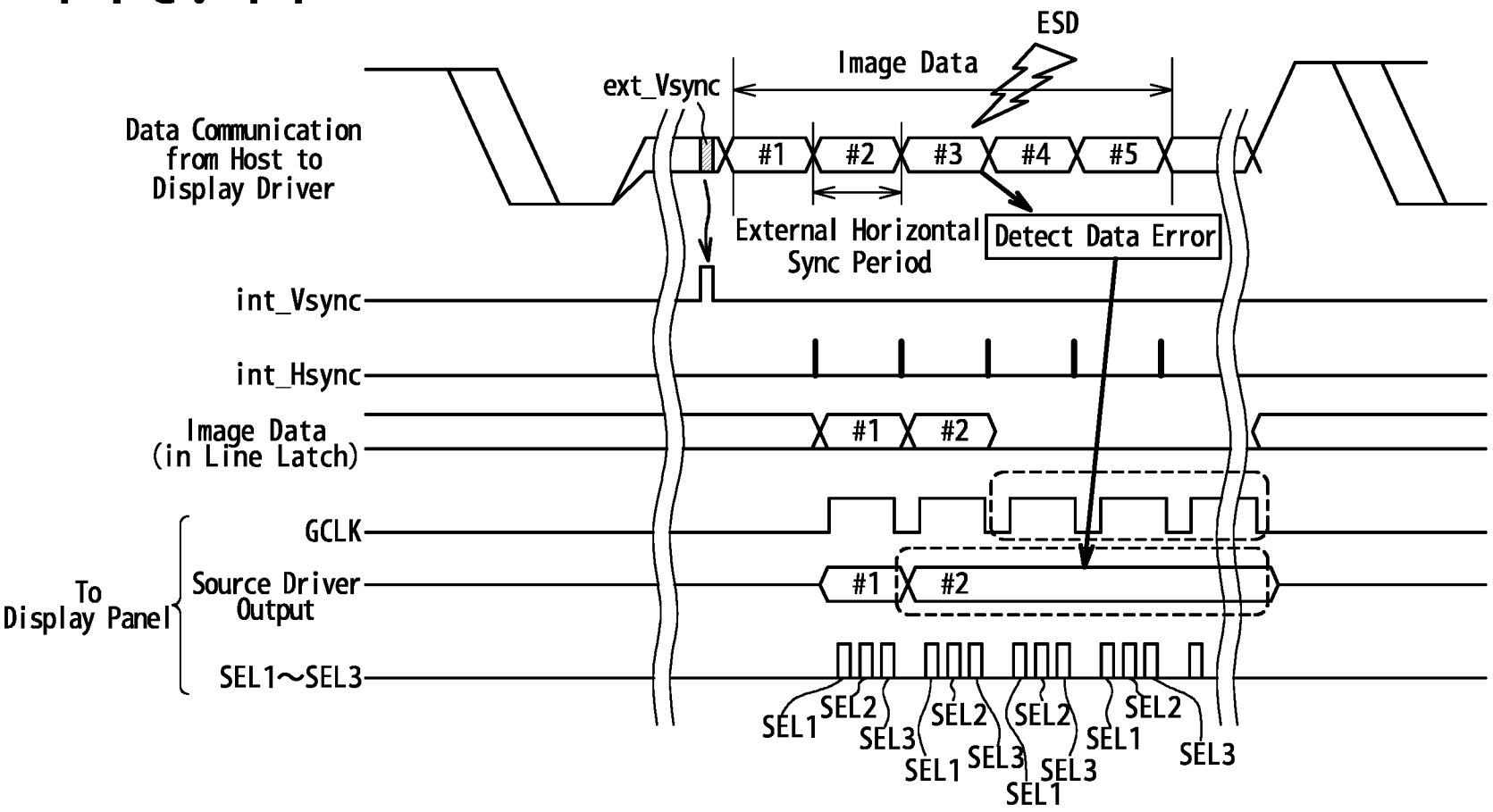
FIG. 11 is a timing chart illustrating an example operation of a display device, according to one or more embodiments.

In one or more embodiments, as illustrated in FIG. 11, when a data error is detected in image data associated with a pixel circuit 7 of a horizontal line, drive signals 8 are generated based on image data associated with pixel circuits 7 of a different horizontal line during the rest of the current vertical sync period. The image data associated with pixel circuits 7 of the different horizontal line is the image data received most recently before the horizontal line for which the data error is detected. Further, the image data associated with pixel circuits 7 of the different horizontal line is free from data error and may be referred to as image data that has been normally received. Illustrated in FIG. 11 is an example operation of the display devices 100 and 100A in embodiments where a data error occurs in the image data associated with the pixel circuits 7 of horizontal line #3. In one or more embodiments, the drive signals 8 are generated in driving the pixel circuits 7 of horizontal lines #3 to #N based on the image data associated with the pixel circuits 7 of horizontal line #2, which are normally received most recently before the image data associated with the pixel circuits 7 of horizontal line #3. In one or more embodiments, the image data associated with the pixel circuits 7 of horizontal line #2 is free from a data error. This operation, which also displays an image correlated to some extent with an image to be originally displayed, may suppress image disturbance perceivable by the user.

Figure 12:
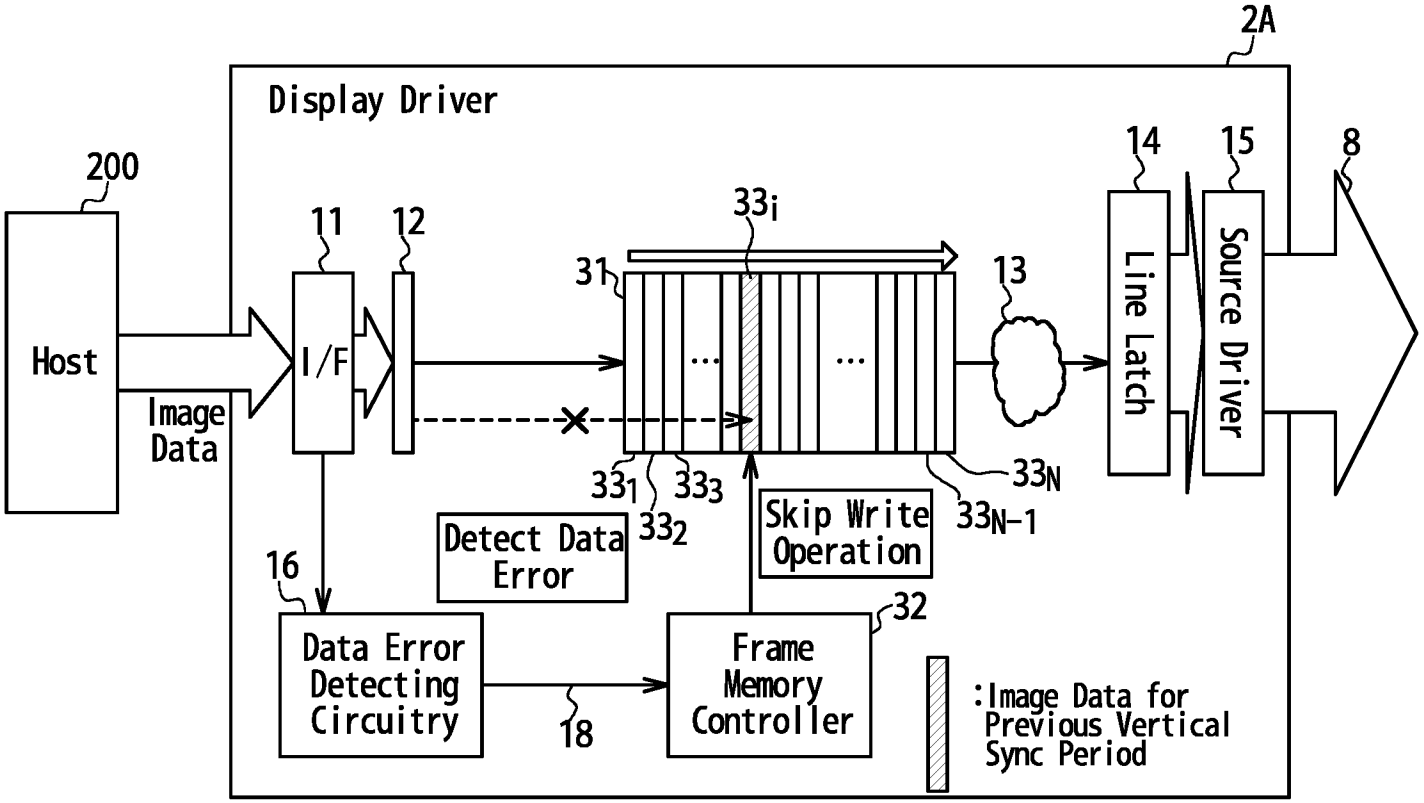
FIG. 12 is a block diagram illustrating an example configuration of a display driver, according to one or more embodiments.

In one or more embodiments, as illustrated in FIG. 12, a display driver 2A comprises a frame memory 31 and a frame memory controller 32.

In various embodiments, the frame memory 31 is configured to receive image data from the buffer memory 12 and temporarily store the same therein. The frame memory 31 may have a capacity enough to store an image corresponding to one frame image, that is, an image displayed in each vertical sync period.

In one or more embodiments, image data of one frame image comprises a plurality of image data blocks, and the plurality of image data blocks are sequentially forwarded to the display driver 2A and stored in the buffer memory 12. The image data blocks stored in the buffer memory 12 may be sequentially forwarded to the frame memory 31. In various embodiments, the frame memory 31 comprises a plurality of memory regions each configured to store one image data block. In one or more embodiments, image data corresponding to one frame image comprise N image data blocks, and the number of memory regions is N. In FIG. 12, the N memory blocks are denoted by the numerals $\mathbf{33}_1$ to $\mathbf{33}_N$. The memory regions $\mathbf{33}_1$ to $\mathbf{33}_N$ may store the N image data blocks, respectively.

In one or more embodiments, the image data blocks stored in the memory regions $\mathbf{33}_1$ to $\mathbf{33}_N$ of the frame memory 31 are sequentially forwarded to the image processing IP core 13. The image processing IP core 13 may be configured to perform image processing on the image data blocks sequentially received from the frame memory 31. Image data generated through this image processing may be forwarded to the source driver 15 and used to drive the respective pixel circuits 7 of the display panel 1.

In one or more embodiments, the frame memory controller 32 is configured to control writing and reading of the image data blocks into and from the frame memory 31. The frame memory controller 32 may be configured to, when an image data block is to be forwarded from the buffer memory 12 to the frame memory 31, select a memory region 33 into which the image data block is to be written. The frame memory controller 32 may be further configured to, when an image data block is to be forwarded from the frame memory 31 to the image processing IP core 13, select a memory region 33 from which the image data block is to be read.

In one or more embodiments, the frame memory controller 32 is configured to receive the data error occurrence notification signal 18 from the data error detection circuitry 16 and control writing and reading of the image data based on the data error occurrence notification signal 18, that is, occurrence of a data error in an image data block. Examples of detected data errors may include a data error that occurs in an image data block in the data communication between the host 200 and the interface 11. This type of data error may occur when ESD noise is applied to a signal line used for the data communication from the host 200 to the display driver 2A. Note that the data error type is not limited to this.

In embodiments as illustrated in FIG. 12, forwarding and writing of an image data block is skipped or omitted based on detection of a data error in the image data block.

A data error may occur in an image data block associated with any memory region $\mathbf{33}_i$ when image data of an image to be displayed in a current vertical sync period is transmitted to the display driver 2A.

In such embodiments, the frame memory controller 32 may control the frame memory 31 so that the image data block associated with the memory region $\mathbf{33}_i$ is not transmitted to or written into the frame memory 31 while image data blocks free from data errors may be forwarded to and written into the associated memory regions 33. In such embodiments, the memory region $\mathbf{33}_i$ continues to store the associated image data block of the image that has been displayed in the previous vertical sync period without being updated, while the memory regions 33 other than the memory region $\mathbf{33}_i$ are updated with associated image data blocks of the image to be displayed in the current vertical sync period.

In one or more embodiment, when the image is displayed in the current vertical sync period, the image data blocks are sequentially read out from the memory regions $\mathbf{33}_1$ to $\mathbf{33}_N$ of the frame memory 31, and the pixel circuits 7 of the display panel 1 are driven based on the image data blocks read out from the memory regions $\mathbf{33}_1$ to $\mathbf{33}_N$. In such embodiments, the pixel circuits 7 associated with the image data blocks free from data errors may be driven based on the image data of the image to be displayed in the current vertical sync period, and the pixel circuits 7 associated with the image data block in which a data error occurs are driven based on the associated image data block of the image that has been displayed in the previous vertical sync period. This operation may suppress image disturbance perceivable by the user when a data error occurs, since an image displayed in a vertical sync period is often similar to that displayed in the previous vertical sync period.

Figure 13:
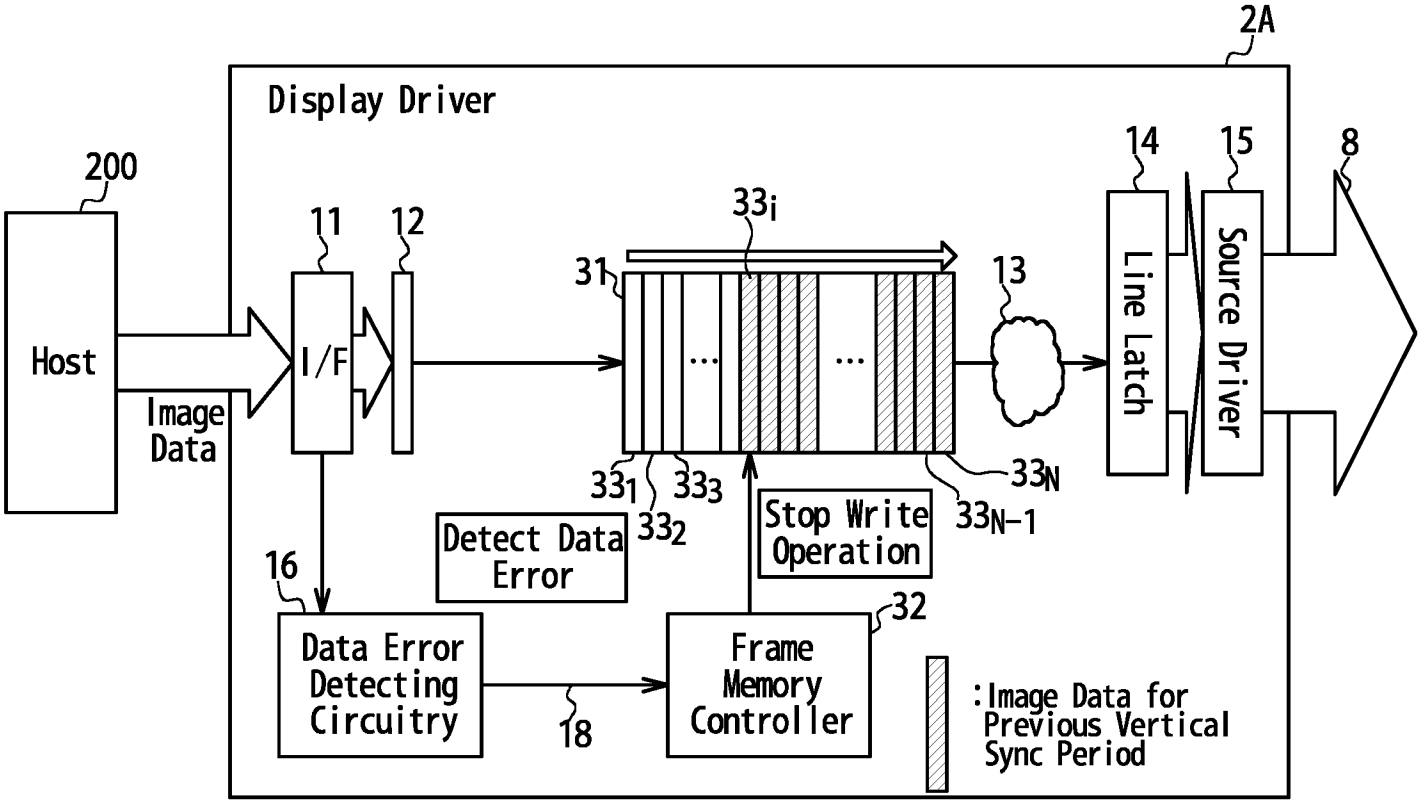
FIG. 13 is a block diagram illustrating an example configuration of a display driver, according to one or more embodiments.

In one or more embodiments, as illustrated in FIG. 13, when a data error occurs in an image data block in transmitting image data of an image to be displayed in a certain vertical sync period to the display driver 2A, the image data block and its following image data blocks associated with this vertical sync period are not forwarded to or written into the frame memory 31.

A data error may occur in an image data block associated with any memory region $\mathbf{33}_i$ in transmitting image data of an image to be displayed in a current vertical sync period to the display driver 2A. In such embodiments, the frame memory controller 32 may control the frame memory 31 so that the image data block associated with the memory region $\mathbf{33}_i$ and following image data blocks are not forwarded to or written into the frame memory 31. As a result of this operation, the memory regions $\mathbf{33}_1$ to $\mathbf{33}_{i-1}$ may be updated with associated image data blocks of the image to be displayed in the current vertical sync period, while the memory regions $\mathbf{33}_i$ to $\mathbf{33}_N$ continue to store the associated image data blocks of the image that has been displayed in the previous vertical sync period without being updated. This operation may suppress image disturbance perceivable by the user when a data error occurs in the image data, since an image displayed in a vertical sync period is often similar to that displayed in the previous vertical sync period.

Figure 14:
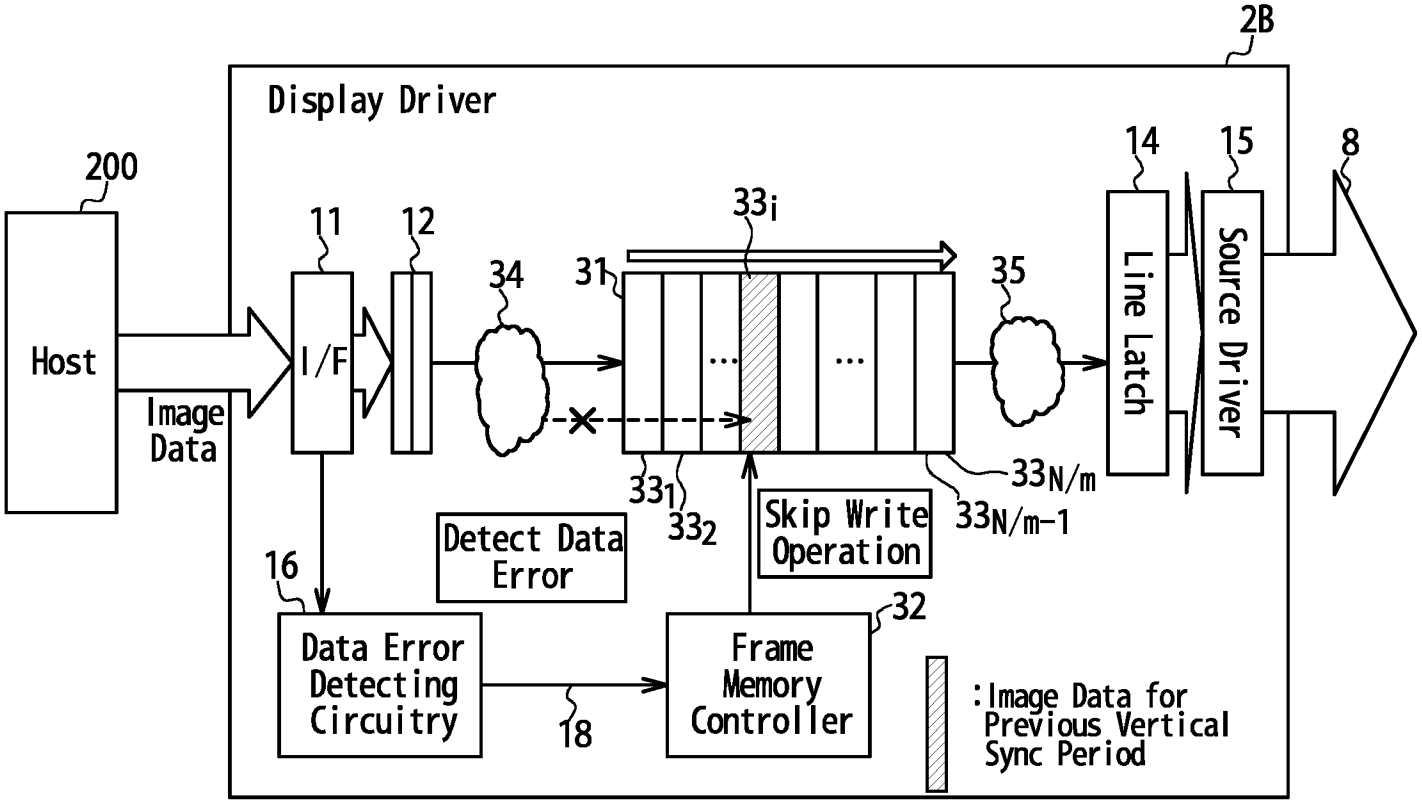
FIG. 14 is a block diagram illustrating an example configuration of a display driver, according to one or more embodiments.

In one or more embodiments, as illustrated in FIG. 14, a display driver 2B is configured to perform a compression process on image data received from the host 200 in units of m image data blocks and store compressed image data obtained through this compression process in the frame memory 31, where m is an integer of two or more. This configuration may be used in embodiments where the number N of image data blocks contained in image data for one frame image is divisible by m. The buffer memory 12 may have a capacity for m image data blocks.

In one or more embodiments, the display driver 2B comprises compression circuitry 34 and decompression circuitry 35. The compression circuitry 34 may be configured to receive image data blocks from the buffer memory 12 and perform the compression process on the received image data blocks to generate the compressed image data. The compression circuitry 34 may be configured to perform the compression process in units of m image data blocks. The compression circuitry 34 may be configured to transmit the compressed image data thus generated to the frame memory 31. In one or more embodiments, the frame memory 31 may comprise N/m memory regions $\mathbf{33}_1$ to $\mathbf{33}_{N/m}$. Each memory region 33 may have a capacity enough to store compressed image data generated from m associated image data blocks. In one or more embodiments, the decompression circuitry 35 is configured to decompress the compressed image data received from the frame memory 31 to generate decompressed image data and supply the same to the line latch 14. In one or more embodiments, the source driver 15 is configured to receive the decompressed image data from the line latch 14 and generate the drive signals 8 to be supplied to the respective source lines 5 based on the received decompressed image data.

In embodiments as illustrated in FIG. 14, when a data error occurs in an image data block, forwarding and writing of the compressed image data generated based on the image data block into the frame memory 31 are skipped or omitted.

A data error may occurs in any of the (i×m+1)-th to ((i+1)×m)-th image data blocks in transmitting image data of an image to be displayed in a current vertical sync period to the display driver 2B where i is an integer from 0 to (N/m−1).

In such embodiments, the frame memory controller 32 may control the frame memory 31 so that the compressed image data generated from the (i×m+1)-th to ((i+1)×m)-th image data blocks is not forwarded to or written into the frame memory 31. In one or more embodiments, the (i×m+1)-th to ((i+1)×m)-th image data blocks are used to generate the compressed image data associated with the memory region $\mathbf{33}_i$ and therefore the compressed image data stored in the memory region $\mathbf{33}_i$ is not updated. In this case, the memory region $\mathbf{33}_i$ may continue to store the compressed image data corresponding to the image to be displayed in the previous vertical sync period without being updated. In various embodiments, compressed image data generated from image data blocks free from data errors are stored in associated memory regions 33 of the frame memory 31. The memory regions 33 other than the memory region $\mathbf{33}_i$ may be updated with compressed image data associated with the image to be displayed in the current vertical sync period.

In one or more embodiments, when the image is displayed in the current vertical sync period, the compressed image data are sequentially read out from the memory regions $\mathbf{33}_1$ to $\mathbf{33}_{N/m}$ of the frame memory 31, and the pixel circuits 7 of the display panel 1 are driven based on the compressed image data read out from the memory regions $\mathbf{33}_1$ to $\mathbf{33}_{N/m}$. In such embodiments, the pixel circuits 7 associated with the image data blocks other than the (i×m+1)-th to ((i+1)×m)-th image data blocks are driven based on the image data blocks of the image to be displayed in the current vertical sync period, and the pixel circuits 7 associated with the (i×m+1)-th to ((i+1)×m)-th image data blocks are driven based on the associated image data blocks of the image that has been displayed in the previous vertical sync period. This operation may suppress image disturbance perceivable by the user when a data error occurs, since an image displayed in a vertical sync period is often similar to that displayed in the previous vertical sync period.

When a data error occurs in an image data block in transmitting image data of an image to be displayed in a vertical sync period to the display driver 2B, forwarding and writing into the frame memory 31 of the compressed image data generated based on the image data block in which the data error occurs and the compressed image data generated based on the following image data blocks associated with this vertical sync period may be skipped or omitted, similarly to the operation illustrated in FIG. 13.

A data error may occur in any of the (i×m+1)-th to ((i+1)×m)-th image data blocks in transmitting image data of an image to be displayed in a current vertical sync period to the display driver 2B where i is an integer from 0 to (N/m−1). In such embodiments, the frame memory controller 32 may control the frame memory 31 so that the compressed image data generated from the (i×m+1)-th to ((i+1)×m)-th image data blocks and their following image data blocks are not forwarded or written into the frame memory 31.

In such embodiments, the memory regions $\mathbf{33}_1$ to $\mathbf{33}_{i-1}$ are updated with compressed image data associated with the image to be displayed in the current vertical sync period, and the memory regions $\mathbf{33}_i$ to $\mathbf{33}_{N/m}$ continue to store the associated compressed image data of the image that has been displayed in the previous vertical sync period without being updated. This operation may suppress image disturbance perceivable by the user when a data error occurs in the image data, since an image displayed in a vertical sync period is often similar to that displayed in the previous vertical sync period.

While various embodiments have been specifically described herein, a person skilled in the art would appreciate that the technologies disclosed herein may be implemented with various modifications.

What is claimed is:

1. A display driver, comprising:

an interface configured to receive image data; and signal supply circuitry configured to supply at least one drive control signal to a display panel based on a detection of a data error in the image data associated with a first horizontal line in a first vertical sync period, wherein the at least one drive signal causes a first pixel circuit and a second pixel circuit to hold, in the first vertical sync period, first hold voltages using previous hold voltages held in a previous vertical sync period, wherein the previous vertical sync period is prior to the first vertical sync period, wherein the previous hold voltages correspond to gray-scale values of respective pixel circuits during the previous vertical sync period, wherein the at least one drive control signal includes a gate reset signal for resetting a shift register of a gate driver in the display panel, and wherein the first pixel circuit is located in the display panel and associated with the first horizontal line, and the second pixel circuit is located in the display panel and associated with a second horizontal line and driven after the first pixel circuit.

2. The display driver of claim 1, wherein the signal supply circuitry is further configured to withhold from asserting gate lines in the display panel that have not been asserted in the first vertical sync period during a period after the detection of the data error in the first vertical sync period.

3. The display driver of claim 1, wherein the signal supply circuitry is further configured to generate a gate mask signal to prohibit assertion of gate lines in the display panel during a period after the detection of the data error in the first vertical sync period.

4. The display driver of claim 1, wherein the signal supply circuitry is further configured to set source lines of the display panel to a high-impedance state after the detection of the data error in the first vertical sync period until an end of the first vertical sync period.

5. The display driver of claim 1, wherein the display panel comprises multiplexer circuitry configured to connect selected source lines of a plurality of source lines to a source driver of the signal supply circuitry, the signal supply circuitry further configured to supply select signals to control selection of the plurality of source lines by the multiplexer circuitry so that none of the plurality of source lines are selected after the detection of the data error in the first vertical sync period until an end of the first vertical sync period.

6. The display driver of claim 1, wherein the at least one drive control signal further includes a gate clock signal for operating the shift register.

7. The display driver of claim 6, wherein the signal supply circuitry is further configured to:

supply the gate clock signal to the gate driver, and not supply the gate clock signal to the gate driver during the period after the detection of the data error in the first vertical sync period.

8. A display driver, comprising:

an interface; and signal supply circuitry comprising a frame memory, wherein the signal supply circuitry is configured to:

supply drive signals to a display panel;

generate compressed image data by compressing image data received via the interface and write the compressed image data into the frame memory, based on a detection of a data error in a first image data block of the image data received via the interface, omit writing the first image data block into the frame memory, and omit updating the compressed image data associated with the first image data block in the frame memory based on the detection of the data error in the first image data block, wherein hold voltages held in a previous vertical sync period are retained responsive to the data error, the hold voltages corresponding to grayscale values of respective pixel circuits during the previous vertical sync period.

9. The display driver of claim 8, wherein the signal supply circuitry is further configured to, based on the detection of the data error in the first image data block of the image data associated with a first vertical sync period, drive pixel circuits associated with the first image data block based on an image data block associated with the previous vertical sync period in displaying an image associated with the first vertical sync period, the previous vertical sync period prior to the first vertical sync period.

10. The display driver of claim 8, wherein the signal supply circuitry is further configured to, based on the detection of the data error in the first image data block of the image data associated with a first vertical sync period, omit writing into the frame memory a second image data block of the image data associated with the first vertical sync period, the second image data block being received after the detection of the data error.

11. The display driver of claim 10, wherein the signal supply circuitry is further configured to, based on the detection of the data error in the first image data block of the image data associated with the first vertical sync period, drive pixel circuits associated with the first image data block and the second image data block to display an image associated with the first vertical sync period in response to image data blocks associated with the previous vertical sync period, the previous vertical sync period prior to the first vertical sync period.

12. A method, comprising:

receiving image data; and supplying at least one drive control signal to a display panel based on a detection of a data error in the image data associated with a first horizontal line in a first vertical sync period, wherein the at least one drive signal causes a first pixel circuit and a second pixel circuit to hold, in the first vertical sync period, first hold voltages using previous hold voltages held in a previous vertical sync period, wherein the previous vertical sync period is prior to the first vertical sync period, wherein the previous hold voltages correspond to grayscale values of respective pixel circuits during the previous vertical sync period, wherein the first pixel circuit is located in the display panel and associated with the first horizontal line, and the second pixel circuit is located in the display panel and associated with a second horizontal line and driven after the first pixel circuit, and wherein supplying the at least one drive control signal to the display panel comprises setting source lines of the display panel to a high-impedance state after the detection of the data error in the first vertical sync period until an end of the first vertical sync period.

13. The method of claim 12, further comprising not asserting gate lines that have been not yet asserted in the first vertical sync period.

14. The method of claim 12, wherein the at least one drive control signal includes a gate reset signal for resetting a shift register of a gate driver in the display panel.

15. The method of claim 14, wherein the at least one drive control signal includes a gate clock signal for operating the shift register.

16. The method of claim 15, wherein supplying at least one drive control signal comprises not supplying the gate clock signal to the gate driver during the period after the detection of the data error in the first vertical sync period.

17. The method of claim 12, wherein supplying the at least one drive control signal to the display panel comprises:

generating a gate mask signal to prohibit assertion of gate lines during a period after the detection of the data error in the first vertical sync period.

18. A display driver, comprising:

an interface configured to receive image data; and signal supply circuitry configured to supply at least one drive control signal to a display panel based on a detection of a data error in the image data associated with a first horizontal line in a first vertical sync period, wherein the at least one drive signal causes a first pixel circuit and a second pixel circuit to hold, in the first vertical sync period, first hold voltages using previous hold voltages held in a previous vertical sync period, wherein the previous vertical sync period is prior to the first vertical sync period, wherein the previous hold voltages correspond to grayscale values of respective pixel circuits during the previous vertical sync period, wherein the first pixel circuit is located in the display panel and associated with the first horizontal line, and the second pixel circuit is located in the display panel and associated with a second horizontal line and driven after the first pixel circuit, and wherein the display panel comprises multiplexer circuitry configured to connect selected source lines of a plurality of source lines to a source driver of the signal supply circuitry, the signal supply circuitry further configured to supply select signals to control selection of the plurality of source lines by the multiplexer circuitry so that none of the plurality of source lines are selected after the detection of the data error in the first vertical sync period until an end of the first vertical sync period.

* * * * *